US006640788B2

(12) United States Patent
Inoue et al.

(10) Patent No.: US 6,640,788 B2
(45) Date of Patent: Nov. 4, 2003

(54) HIGH PRESSURE FUEL PUMP

(75) Inventors: Hiroshi Inoue, Chiryu (JP); Tatsumi Oguri, Okazaki (JP)

(73) Assignee: Denso Corporation, Kariya (JP)

( * ) Notice: Subject to any disclaimer, the term of this patent is extended or adjusted under 35 U.S.C. 154(b) by 62 days.

(21) Appl. No.: 10/082,258

(22) Filed: Feb. 26, 2002

(65) Prior Publication Data

US 2002/0117154 A1 Aug. 29, 2002

(30) Foreign Application Priority Data

Feb. 28, 2001 (JP) ..... 2001-054486

(51) Int. Cl.[7] ..... F02M 37/04
(52) U.S. Cl. ..... 123/506; 251/129.15
(58) Field of Search ..... 123/446, 506; 335/249, 261; 251/129.15

(56) References Cited

U.S. PATENT DOCUMENTS 4,777,921 A 10/1988 Miyaki et al. ..... 123/506
4,938,451 A * 7/1990 Weaver et al. ..... 251/129.15
5,603,482 A * 2/1997 Mott et al. ..... 251/129.15
2003/0052291 A1 * 3/2003 Roth ..... 251/129.15

FOREIGN PATENT DOCUMENTS

EP 1013922 A2 6/2000
JP 8-49617 2/1996

* cited by examiner

*Primary Examiner*—Thomas N. Moulis
(74) *Attorney, Agent, or Firm*—Nixon & Vanderhye P.C.

(57) ABSTRACT

A high pressure fuel pump, to suppress the effect of a pressure pulsation caused by the operation of a moving member and whose valve part shows stable response, has a flow amount control valve for adjusting the supply amount of fuel discharged by the sliding reciprocating movement of a plunger fitted in a pump chamber by controlling the opening or closing of a spill port by a valve part, the flow amount control valve has a stem part arranged in an operating chamber disposed on the side opposite to the pump chamber and transmits an urging force from a moving part to the valve part, the urging force being applied by the moving part to the valve part in the direction that separates the valve part from the valve seat, and is more slender than the moving part.

16 Claims, 7 Drawing Sheets

HIGH PRESSURE FUEL PUMP

CROSS REFERENCE TO RELATED APPLICATION

This application is based on and incorporates by reference Japanese Patent Application No. 2001-54486 filed on Feb. 28, 2001.

BACKGROUND OF THE INVENTION

1. Field of the Invention

Embodiment of the present invention relate to a high pressure fuel pump used for a gasoline engine and a diesel engine in which fuel is directly injected into a cylinder and is burned. In particular, at least one embodiment of the invention relates to a high pressure fuel pump provided with a flow amount control valve capable of controlling the flow amount of a high pressure fuel supplied to a delivery pipe such as a common rail (high pressure accumulation pipe), or the like.

2. Description of the Related Art

In recent years, gasoline and diesel engines are required to satisfy not only high power, low noise, and low fuel consumption requirements but also rigorous emission regulations. In order to meet these requirements, attention has been paid to a direct injection type gasoline engine and a direct injection type diesel engine in which the injection timing and the injection amount of the fuel are controlled with high accuracy. Usually in these engines, the fuel is drawn from a fuel tank by a low pressure fuel pump and is further pressurized by a high pressure fuel pump and supplied to a delivery pipe such as a common rail or the like and is directly injected into cylinders through injectors connected to the delivery pipe.

In order to control the injection timing and the injection amount of the fuel with high accuracy, the injectors and the high pressure fuel pump are electronically controlled. Such a high pressure fuel pump electronically controls the fuel supply amount to the delivery pipe according to the injection amount of the injectors. This is unlike a fuel injection pump in the related art for controlling the flow amount of the fuel by adjusting the positional relationship between a reed provided on a plunger and an intake/exhaust port. To be more specific, by controlling the timing of overflowing the fuel in a pump chamber to a low pressure side, the supply amount of the fuel compressed and discharged to the delivery pipe by the plunger is adjusted to keep a fuel pressure in the delivery pipe at a predetermined pressure.

Here, as to the flow amount control valve which is important in controlling the flow amount of the high pressure fuel pump, various propositions have been made and among them, a pilot type flow amount control valve capable of reducing cost is disclosed in JP-A No. 8-49617 and JP-A No. 2000-186649.

A solenoid spill valve 20 disclosed in the JP-A No. 8-49617 is a pilot type inwardly opening (solenoid) valve comprising a needle valve 4 for opening/closing a seat plane 12 provided in the overflow passage of the fuel and a moving member 6 for driving the needle valve 4. Here, the numerals in the parentheses denote the reference numerals shown in FIG. 1 in the official gazette. In the solenoid spill valve 20, a fuel inlet passage 11, which is to be an overflow passage, is made to communicate with a hydraulic chamber 8 provided on the back of the needle valve 4 by a slim pressure introduction passage 16. However, since the moving member 6 moves in the hydraulic chamber 8 of a small volume, a pressure pulsation is caused and is propagated through the pressure introduction passage 16 with a time lag and causes variations in the response of the needle valve 4. Further, the pressure introduction passage 16 is provided with an orifice 14. In order to eliminate the pressure pulsation causing the variations in the response of the needle valve 4, the diameter of the orifice 14 needs to be made considerably small, or conversely, the diameter of the pressure introduction passage 16 needs to be made considerably large, which is not realistic in either case because of manufacturing costs.

The high pressure fuel pump 1 disclosed in JP-A No. 2000-186649 has a pilot type outwardly opening (solenoid) valve comprising an intake valve 30 for opening/closing a valve seat 34 provided in the fuel overflow passage and a control valve 50 for driving the intake valve 30. Here, the numerals in the parentheses denote the reference numerals shown in FIG. 2 in the official gazette. In the control valve 50, the fuel in a control chamber 45 provided on the head 48 of the intake valve 30 flows in or out to temporarily make the control chamber 45 a rigid body thereby controlling the opening/closing of the valve seat 34 by the intake valve 30. Also in this case, since the volume of the control chamber 45 is small, the volume of the control chamber 45 fluctuates substantially by the operation of the control valve 50, and a large pressure pulsation caused by the fluctuation of the volume of the control chamber 45 is propagated to a fuel well 24 through a communication passage 46. It is then propagated to a pump chamber 16 in which the valve seat 34 is arranged through an insertion hole 35 to cause variations in the response of the intake valve 30, which might cause the deterioration of controllability.

Here, as to a valve structure, a "pilot type valve" means a valve part abutting against a valve seat surface is separated from a driving part, and an "inwardly opening valve" means a valve in which the seat surface of a port is disposed on the driving part side (inside) and in which the valve part is opened inwardly. The "outwardly opening valve" means a valve in which the seat surface of a port is disposed on the side opposite to the driving part (outside) and which the valve part is opened outwardly. These descriptions are used throughout the specification and are meant to have the same meaning.

SUMMARY OF THE INVENTION

The present invention has been made in view of these circumstances. It is an object of at least one embodiment of the present invention to provide a high pressure fuel pump having a flow amount control valve of excellent controllability which can suppress the effect of a pressure pulsation caused by the operation of a driving part (moving member) and whose valve shows stable response.

Thus, the present inventor has conducted research to solve the problem described above, and has discovered an idea for making a flow amount control valve of a pilot valve type, that is, an outwardly opening valve. Additionally discovered is a way of increasing the rate of the total volume of an operating chamber, in which the moving member is disposed, to accommodate the variable volume thereof, and thus has achieved a high pressure fuel pump of the present invention.

That is, a high pressure fuel pump in accordance with an embodiment of the present invention is characterized as a high pressure fuel pump including a pump body having a pump chamber formed in such a way as to communicate with a low pressure fuel passage connected to the supply source of a low pressure fuel and a high pressure fuel passage for supplying a high pressure fuel to an injector side. Additionally, a plunger is fitted into the pump chamber and supplied with a driving force from a driving source to slidably move back and forth in the pump chamber thereby to draw and discharge fuel. Also provided is a flow amount control valve for adjusting the flow amount of the high pressure fuel to the high pressure fuel passage by opening or closing a spill port provided in the overflow passage of the fuel which communicates with the pump chamber. The flow amount control valve has a valve body having an operating chamber which is formed on the side opposite to the pump chamber with respect to the spill port and communicates with the overflow passage. A valve part exists which is urged in the direction that seats the valve part on a valve seat formed on the pump chamber side of the spill port and which is separated from or seated on the valve seat to open or close the spill port. Furthermore, there is a moving part which is separated from the valve part and disposed in the operating chamber and electromagnetically controls the opening or closing of the spill port by the valve part. Finally, a stem part is provided which is disposed in the operating chamber and transmits an urging force from the moving part to the valve part, the urging force being applied by the moving part to the valve part in the direction that separates the valve part from the valve seat, and which is more slender than the moving part. Since the flow amount control valve is a pilot type outwardly opening valve in which the valve part is separated from the moving part, it is possible to improve the response of the valve part and it is not necessary to make the respective parts with high machining accuracy, for example, in concentricity or the like, which makes it possible to manufacture the flow amount control valve at a comparatively low cost.

In addition, in the flow amount control valve in accordance with an embodiment of the present invention, the slender stem part disposed in the operating chamber is interposed between the moving part and the valve part and the switching of the urging force applied to the valve part by the stem part makes it possible to surely open or close the spill port. Therefore, since the stem part is more slender than the moving part, the volume (V) formed in the operating chamber is made larger. Then, even if the moving part is moved in the operating chamber to produce a change in volume ($\Delta V$), the rate of change in volume ($\Delta V/V$) is relatively small in terms of the whole operating chamber and thus a fluctuation in pressure (pressure pulsation) caused by the movement of the moving part becomes small. Therefore, the variations in the response of the valve part, which is caused by the pressure pulsation, is reduced to improve the controllability of the flow amount control valve.

In this connection, it is essential only that the degree of "slenderness" of the stem part provide the stem part with the rigidity necessary for the stem part to function as the stem part. There is no restraint on size or shape. For example, in the case where a moving part having a large diameter is fitted in a cylindrical operating chamber, it is acceptable that the stem part is formed in the shape of a column having a diameter smaller than the moving part. Further, the operating chamber is formed in various shapes, for example, the volume (V) of the operating chamber may be partially expanded.

Still further, although it is necessary that the moving part be separated from the valve part, it is not necessary that the stem part be separated from the moving part and the valve part. For example, the stem part may be integral with the moving part and the stem part may be integral with the valve part. Of course, it is possible to support the stem part with an appropriate guide part and to form them in a three-way structure.

Urging the valve part in the direction that seats the valve part on the valve seat or urging the valve part in the direction that separates the valve part from the valve seat by the moving part can be performed by an elastic member such as a coil spring or a coned disc spring. Although it is thought that such urging can be performed by an electromagnetic force, the urging by the use of the elastic member can reduce the cost and the size of the flow amount control valve. Then, for example, it is preferable that the foregoing moving part elastically urge the foregoing stem part in the direction which separates the valve part from the valve seat and that the elastic urging is released by the application of an electromagnetic force. In this respect, of course, in order to surely close the spill port without putting the valve part into contact with the stem part when the plunger pressurizes the fuel, the length of the stem part needs to be set in such a way that the displacement (L1) of the moving part is larger than the displacement of the valve part (L2) (L1>L2).

It is preferable that the operating chamber constitute at least a part of a fuel well communicating with the low pressure fuel passage and that the spill port serves also as the intake port of the low pressure fuel to the pump chamber.

This can make the low pressure fuel passage simple and reduce the size of the high pressure fuel pump. Further, since the spill port serves also as the intake port, a force in accordance with the movement of the plunger is applied to the valve part disposed at the spill port to further improve the response of the valve part. For example, in the case where the plunger is in the intake stroke (i.e. a down-stroke), a negative pressure is applied to the plunger side of the valve part to move the valve part in the direction that opens the intake port. Conversely, in the case where the plunger is in the discharge stroke (an up-stroke), a positive pressure is applied to the plunger side of the valve part to move the valve part in the direction that closes the intake port. In this manner, both of the opening response and the closing response of the valve part can be improved.

Incidentally, the pump body may be separated from or integrated with the valve body. Further, the flow amount control valve varies the flow amount of the fuel so as to adjust the fuel pressure in the delivery pipe such as a common rail, and in addition, may adjust the timing of discharging the fuel. The engine employing the high pressure fuel pump in accordance with embodiments of the present invention is not limited to a direct injection type gasoline engine or a direct injection type diesel engine and is not limited to a common rail type engine, either. For example, in the case of the diesel engine, not only the direct injection type engine but also a swirl chamber type engine and a pre-combustion chamber type engine can employ this high pressure fuel pump. Further an in-line fuel injection pump or a distribution type fuel injection pump in the related art can be used as a high pressure, electronically controlled fuel pump.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE PREFERRED EMBODIMENTS

By enumerating the preferred embodiments of a high pressure fuel pump, embodiments of the present invention will be described in detail. The following description of the preferred embodiments is merely exemplary in nature and is in no way intended to limit the invention, its application, or uses.

Figure 1:
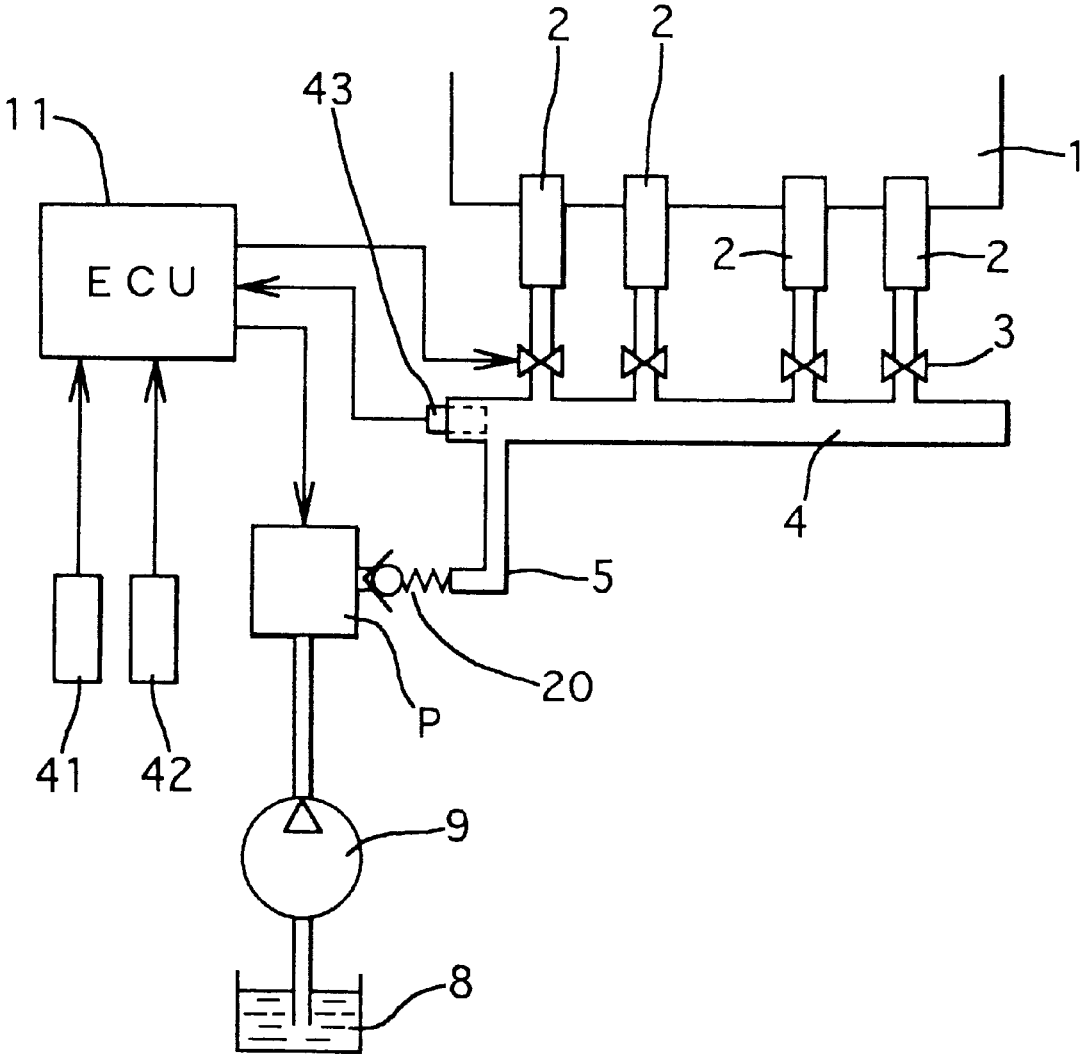
FIG. 1 is a diagram of a fuel system employing a high pressure fuel pump in accordance with an embodiment of the present invention.

The system diagram of a fuel system using a high pressure fuel pump P in accordance with the present invention is shown in FIG. 1. As is evident from FIG. 1, a combustion chamber of each of the cylinders of an engine 1 is provided with an injector 2 and the injection of the fuel into the engine 1 from the injector 2 is controlled by turning on or off a solenoid valve 3 for controlling injection. Here, the engine 1 may be a gasoline engine or a diesel engine.

The injectors 2 are connected to a common rail 4 which is a high pressure accumulated pipe common to the respective cylinders and the fuel in the common rail 4 is injected into the engine 1 by the injector 2 while the solenoid valve 3 for controlling injection is opened. A stable, high fuel injection pressure needs to be accumulated in the common rail 4. Thus, the high pressure fuel pump P of a variable flow amount type supplies fuel drawn from a fuel tank 8 by a publicly known low pressure pump 9 to the common rail 4 through a delivery valve 20 and a delivery pipe 5 while pressurizing the fuel to a high pressure and controlling the flow amount, thereby keeping the fuel in the common rail 4 at a predetermined pressure. The detailed structure of the high pressure fuel pump will be described below.

This fuel system is controlled by an electronic control unit (ECU) 11. The ECU 11 receives an engine speed signal and a load information signal from an engine speed sensor 41 and a load sensor 42, respectively, as inputs and computes an optimal injection timing and an injection amount (injection period) in response to the state of the engine on the basis of these signals and outputs a control signal to a solenoid valve for controlling an injection amount. At the same time, the ECU 11 outputs a control signal to an electromagnetic driving part 130 of the high pressure fuel pump P, which will be described below, so that the injection pressure of the injector 2 becomes optimal. In other words, the ECU 11 receives a fuel pressure signal input from a pressure sensor 43 provided on the common rail 4 and controls the flow amount of the high pressure fuel pump P by the use of the flow amount control valve so that the fuel pressure becomes the optimal pressure set in advance according to the load and the speed of the engine 1.

Incidentally, the fundamental structure of the high pressure fuel pump P like this is publicly known, but the flow amount control valve of the high pressure fuel pump of the present embodiment has a feature that the flow amount control valve of the publicly known high pressure fuel pump does not have.

Figure 2:
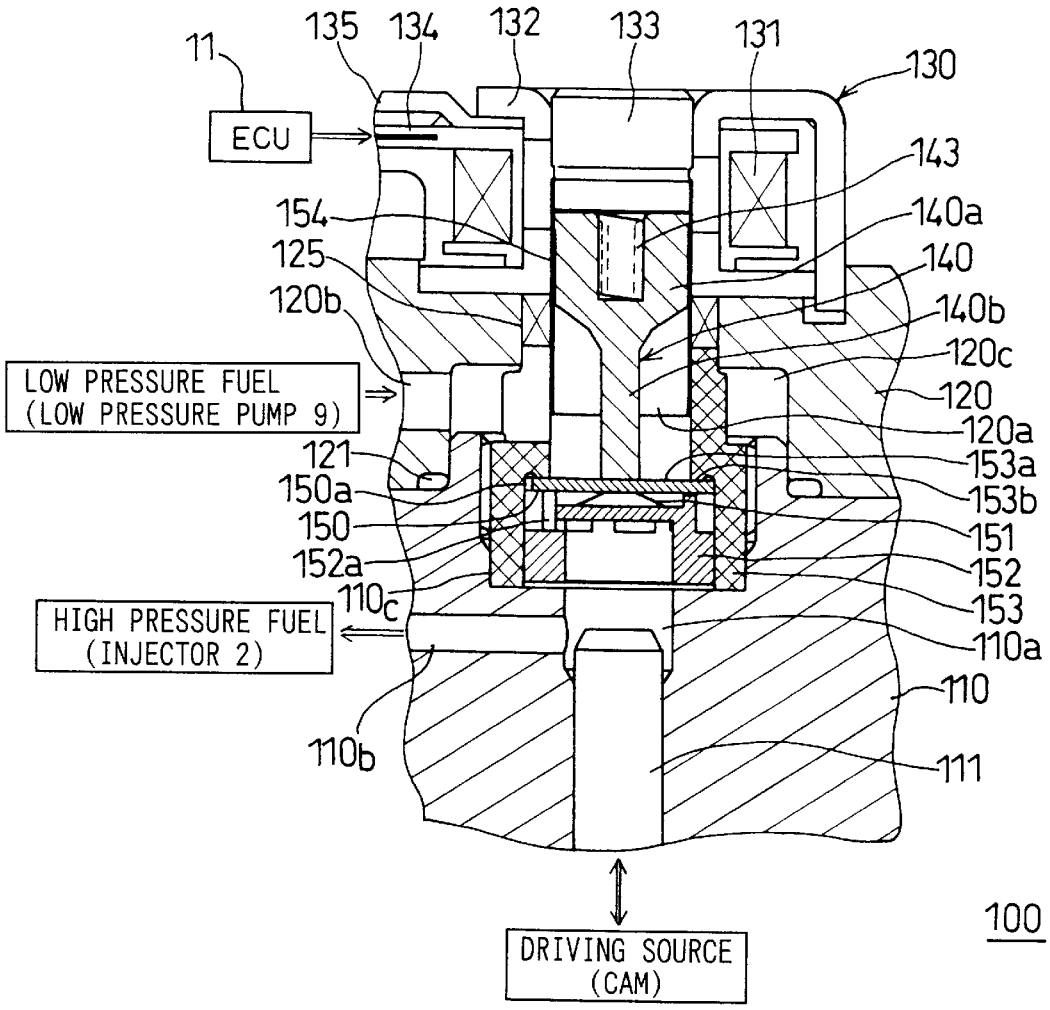
FIG. 2 is a cross-sectional view showing a flow amount control valve of a first embodiment in accordance with the present invention.

Hereinafter, the flow amount control valve 100 of a first embodiment will be described with reference to FIG. 2. The flow amount control valve 100 is constituted mainly by a pump body 110, a valve body 120, an electromagnetic driving part 130, a lifter 140, and a valve part 150. In the pump body 110, a cylindrical pump chamber 110*a* is formed and a plunger 111 is fitted into the pump chamber 110*a*. Then, the plunger 111 is reciprocated up and down to change the volume of the pump chamber 110*a*, whereby the fuel is drawn or discharged. The plunger 111 is moved up and down by a cam (not shown) rotated by the engine 1. Further, the pump chamber 110*a* communicates with a high pressure fuel passage 110*b* and the high pressure fuel is sent through the delivery valve 20, the delivery pipe 5 and the common rail 4 to the injector 2. Still further, a valve receiving chamber 110*c* having a diameter larger than the pump chamber 110*a* is formed in a top portion (in the drawing) of the pump body 110 and communicates with the pump chamber 110*a*.

Into the valve receiving chamber 110*c* is inserted a stepped valve housing 153 forming a spill port 153*a* and nearly shaped like a cylinder. The valve housing 153 has a disc-shaped valve part 150 disposed inside and an annular valve seat 153*b*, on which the valve part 150 is seated, on the outer peripheral side of the spill port 153*a*. Then, when the seat surface of the valve part 150 is separated from or seated on the valve seat 153*b*, the spill port 153*a* is opened or closed.

Into the inner peripheral side of the valve housing 153 are fitted a coned disc spring 151 for urging the valve part 150 to the valve seat 153*b* side (in the direction that seats the valve part 150 on the valve seat 153*b*) and a stepped holding member 152 nearly shaped like a cylinder for supporting the coned disc spring 151 and to be the valve seat of the valve part 150. Here, the valve part 150 corresponds to the valve part defined in the present invention. A plurality of notches 150*a* are formed on the outer peripheral side of the valve part 150 and notches 152*a* shaped like a comb are formed also on the top portion of the holding member 152 and the fuel flows from the spill port 153*a* to the pump chamber 110*a* through these notches.

The valve body 120 has a depressed portion at the bottom and forms a fuel well 120*c* between the depressed portion and the top surface of the pump body 110 (in the drawing). The valve body 120 is tightly joined to the pump body 110 by bolts (not shown) with a sealing member 121 inserted therebetween to hermetically seal the fuel well 120*c*. The fuel well 120*c* communicates with a low pressure fuel passage 120*b* and is supplied with the low pressure fuel from a low pressure fuel pump 9 such as a feed pump or the like and the overflowed low pressure fuel is returned to the fuel tank 8 through the low pressure pump 9. Further, the valve body 120 has an opening at the top and a cylindrical valve case 154 is fitted in the opening and is hermetically sealed with the valve body 120 by a sealing member 125. Still further, in the opening in the top portion of the valve case 154 is fixedly swaged a circular column-shaped iron core 133 of the electromagnetic driving part 130. In this manner, in the present embodiment, the operating chamber 120*a* is partitioned by the valve case 154 and the iron core 133.

In the operating chamber 120*a* is disposed a lifter 140 comprising a moving part 140*a* shaped like a circular column and a stem part 140*b* extending in the direction of the valve part 150 from the moving part 140*a* and the valve case 154 having the moving part 140*a* fitted therein serves also as the guide of the moving part 140*a*. This lifter 140 is the integrated member of the moving part 140*a* and the stem part 140*b* defined in the present invention.

In the top of the moving part 140*a* is formed a cylindrical spring chamber with a bottom in which a coil spring 143 is disposed. The coil spring 143 has one spring seat on the bottom surface of the iron core 133 and urges the lifter 140 to the valve part 150 side (in the direction that separates the valve part 150 from the valve seat). Here, in the present embodiment, the urging force (F1) of the valve part 150 is made larger, by the coil spring, than the urging force (F2) of the valve part 150 by the cone disc spring 151 (F1>F2). Thus, when an electromagnetic force is not applied to the moving part 140*a* by the electromagnetic driving part 130, the valve part 150 is urged in the direction that separates the valve part 150 from the valve seat.

The electromagnetic driving part 130 is comprised of a solenoid coil 131 disposed around the iron core 133 fitted in a frame 132 and a connector 135 for receiving wiring 134 for supplying a control signal (electric power) to a solenoid coil 131. When a current is passed through the solenoid coil 131, a magnetic circuit is formed to attract the moving part 140*a* made of a magnetic material to the iron core 133 to relieve the urging force applied to the valve part 150 by the lifter 140. By switching the passage of the current through the solenoid coil 131, the spill port 153*a* is opened or closed by the valve part 150 and further the flow amount of the high pressure fuel oil is adjusted.

Figure 3A:
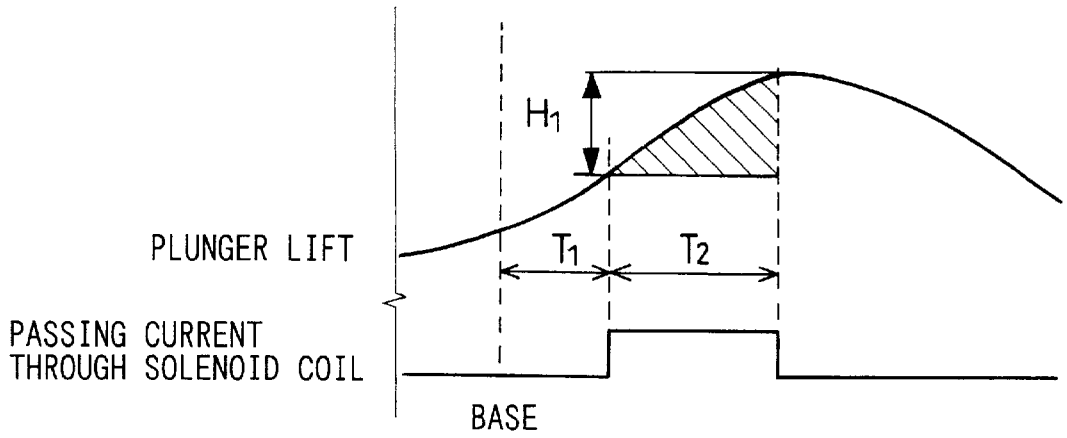
FIG. 3A is a diagram showing plunger lift and current through a solenoid coil in accordance with an embodiment of the present invention.

For example, in an up stroke of the plunger 111 as shown in FIG. 3A, take a case where a current is passed through the solenoid coil 131 for a time T2, after a predetermined time period T1 elapses, from the time when the base position of the cam of the driving source of the plunger 111 is detected. When the current is not passed through the solenoid coil 131, the spill port 153*a* is opened and the fuel in the pump chamber 110*a* is returned to the low pressure fuel passage 120*b* through the spill port 153*a* and is not discharged to the high pressure fuel passage 110*b*. On the other hand, when the current is passed through the solenoid coil 131, the spill port 153*a* is closed and the fuel in the pump chamber 110*a* (fuel corresponding to the shaded area in the drawing) is compressed and discharged to the high pressure fuel passage 110*b* during a period from the time when the spill port 153 is closed to the time when the plunger is moved to the top dead center position (by a plunger lift H1).

In this manner, by controlling the timing (time T1) of passing the current through the solenoid coil 131, it is possible to adjust the pre-stroke amount of the plunger 111 and thus to control the flow amount (fuel pressure in the common rail 4) and the timing of fuel flow to the high pressure fuel passage 110*b*. In this connection, the timing and the period of time of passing the current are determined by the operation of the ECU 11 such as computation or comparison with a map set in advance on the basis of the injection amount of the injector 2 and the engine speed.

Figure 3B:
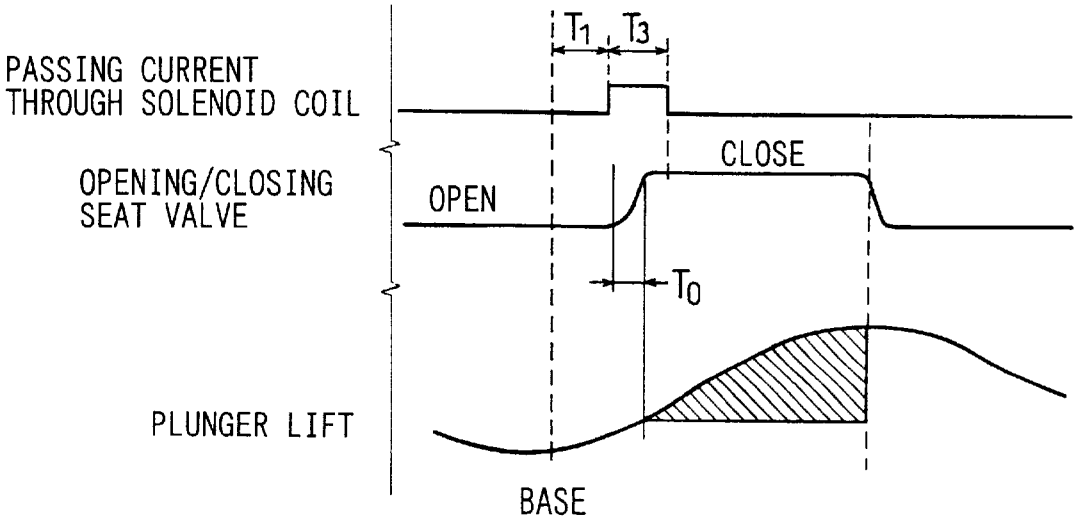
FIG. 3B is a diagram showing current through a solenoid coil, opening/closing of a seat valve, and plunger lift in accordance with an embodiment of the present invention.

Incidentally, since the flow amount control valve 100 is the pilot type outwardly opening valve in the present embodiment, for example, characteristically shown in FIG. 3B, the period of time for passing the current through the solenoid coil 131 can be shortened from the time T2 to the time T3. The time T3 is set at a value slightly larger than a response time of T0 required to close the valve part 150. This is due to the following operation.

When the passing of current through the solenoid coil 131 is started in the up-stroke of the plunger 111, the lifter 140 is attracted to the iron core 133 to relieve the urging force applied to the valve part 150. Since the plunger 111 is in an up-stroke, a positive pressure is applied to the valve seat 150 from the pump chamber 110*a* side and the valve seat immediately closes the spill port 153*a*. When the spill port 153*a* is closed, the fuel pressure in the pump chamber 110*a* sharply increases and thus this high fuel pressure keeps the spill port 153*a* closed. Then, the force applied by the high fuel pressure to the valve part 150 in the direction that seats the valve part 150 on the valve seat, is much larger than the urging force by the coil spring 143 in the direction that separates the valve part 150 from the seat.

Thus, once the spill port 153*a* is closed by the valve part 150 in the up-stroke of the plunger 111, even if the passing of the current through the solenoid coil 131 is stopped, the valve part 150 is not separated from the valve seat 153*b*, that is, the spill port 153*a* is not opened. In this manner, the time during which the current is passed through the solenoid 131 can be shortened to save power consumption and further, control by the ECU 11 can be simplified because the ECU 11 needs only to control the passage of the current for the short time T3.

On the other hand, when the plunger is in a down-stroke, a negative pressure is applied to the valve part 150 and thus even if the current is passed through the solenoid coil 131, the spill port 153*a* is automatically opened. Then, the low pressure fuel is drawn into the pump chamber 110*a* from the fuel well 120*c* and the low pressure fuel passage 120*b*. Therefore, at this time, the spill port 153*a* serves also as a suction port.

As described above, in the case of the high pressure fuel pump P of a flow amount control type like the present embodiment, it is the timing of opening the spill port 153*a* (the time T1 in FIGS. 3A and 3B) that is important in the control. In the case of the pilot type outwardly opening valve, the valve part is in the free state and hence might be moved unexpectedly by the effect of pressure fluctuation (effect of the pressure pulsation). However, since the stem part 140*b* is formed with a diameter considerably smaller than the moving part 140*a* in the high pressure fuel pump P of the present embodiment, a large volume (V) is formed in the fuel well 120*c* including the operating chamber 120*a*. As a result, even if the moving part 140*a* is moved up and down in the operating chamber 120*a* to produce a fluctuation of volume ($\Delta V$), a rate of fluctuation of volume $\Delta V/V$ is small and thus the pressure pulsation is small. Therefore, it is possible to provide a high pressure fuel pump P capable of suppressing the movement of the valve part 150 caused by an uncontrollable pressure pulsation. Therefore, the fuel pump is capable of being consistently and advantageously controlled.

Figure 4:
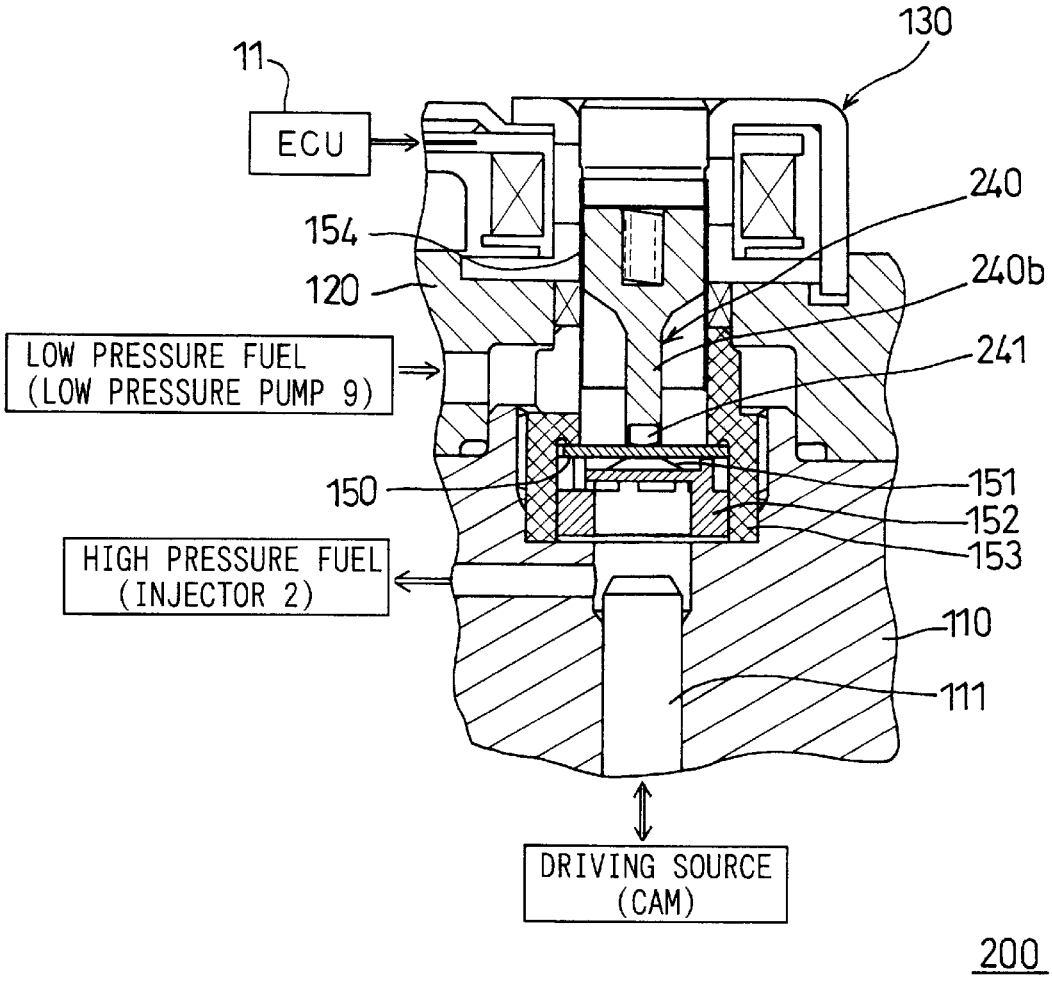
FIG. 4 is a cross-sectional view showing a flow amount control valve in accordance with a second embodiment of the present invention.

A flow amount control valve 200 in accordance with a second embodiment of the present invention is shown in FIG. 4. Here, the same parts as in the first embodiment are denoted by the same reference characters, therefore, descriptions of those parts will be omitted. The flow amount control valve 200 has a lifter 240, similar to the lifter 140 of the first embodiment. In the lifter 240, a hard wear-resisting member 241 exists in a bottom end portion, the same end portion abutting against the valve part 150. The lifter 240 has a swaged brim. Although the lifter 240 is made of a comparatively soft material because it is also a magnetic material, by providing the bottom end portion of the stem part 240*b* with the wear-resisting material 241, even if the stem part 240*b* repeatedly contacts the valve part 150 at a high speed for a long time, it is possible to prevent the stem part 240*b* from wearing, thus ensuring stable controllability.

Figure 5:
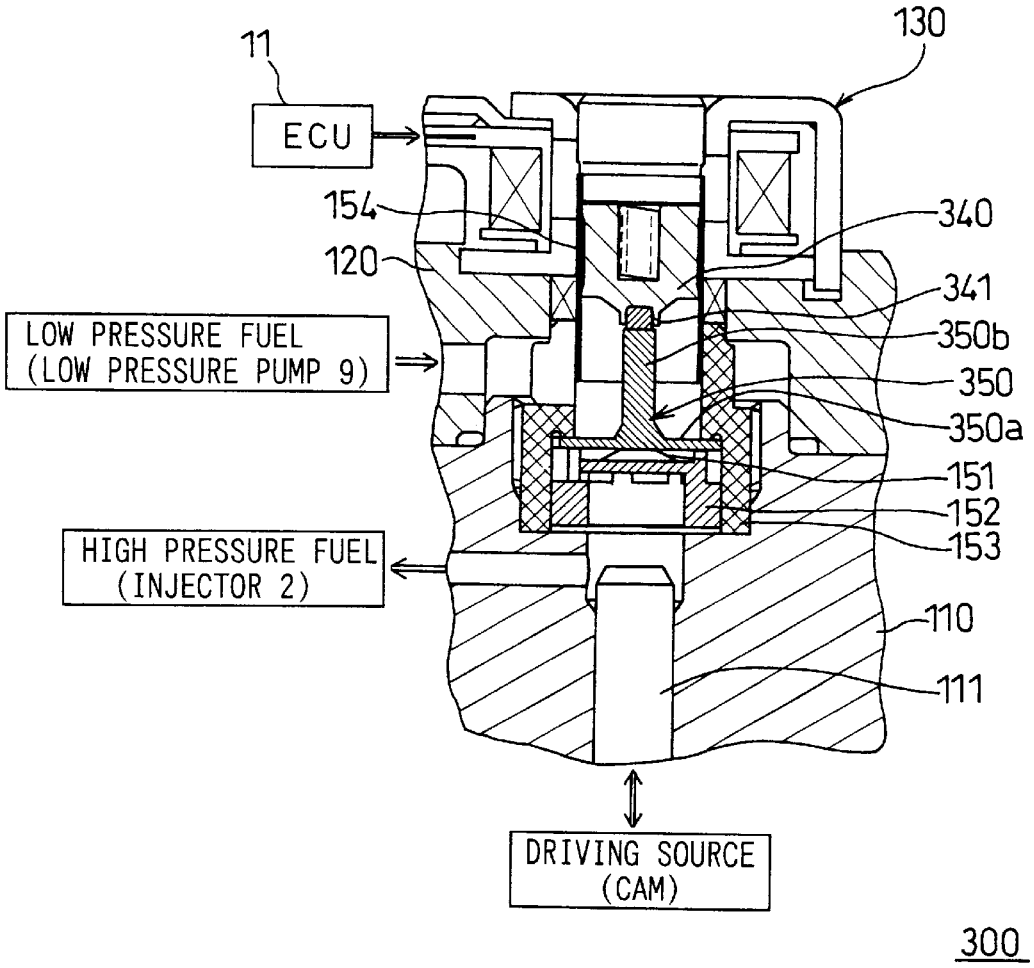
FIG. 5 is a cross-sectional view showing a flow amount control valve in accordance with a third embodiment of the present invention.

A flow amount control valve 300 in accordance with a third embodiment of the present invention is shown in FIG. 5. The flow amount control valve 300 has a moving member 340 and a valve part 350 which are similar to the lifter 140 and the valve part 150 in the first embodiment. In other words, the valve part 350*a* is formed integrally with a stem part 350*b* to form a valve part 350. The stem part 350*b* is separate from the moving member 340. Further, a wear-resisting member 341 exists in an end portion of the moving member 340 to improve wear resistance similar to the second embodiment.

Figure 6:
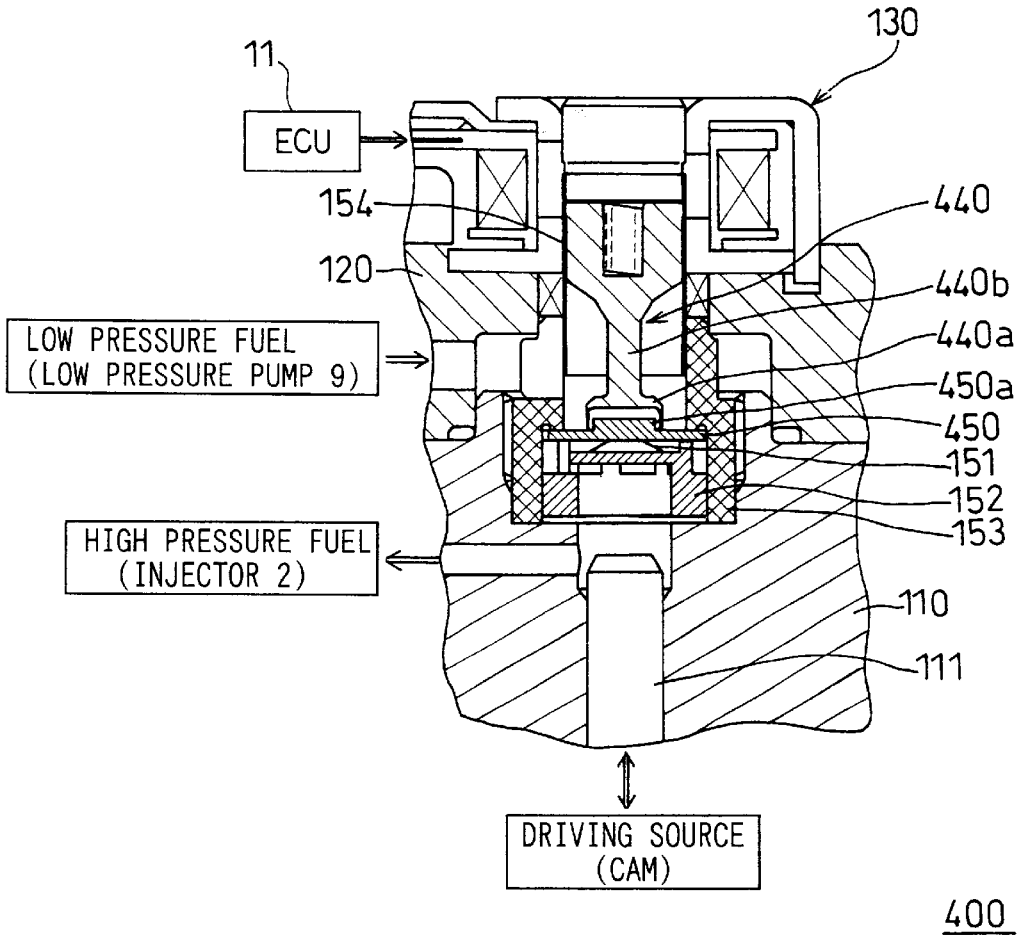
FIG. 6 is a cross-sectional view showing a flow amount control valve in accordance with a fourth embodiment of the present invention.

A flow amount control valve 400 in accordance with a fourth embodiment of the present invention is shown in FIG. 6. The flow amount control valve 400 has a lifter 440 and a valve part 450, which are similar to the lifter 140 and the valve part 150 in the first embodiment. A projecting portion 450*a* shaped like a small circular disc is formed in a projecting manner in the center of the top surface of the valve part 450 and the lifter 440 has a depressed portion 440*a* to be fitted with the projecting portion 450*a* at the bottom end portion of the stem part 440*b*. Since the projecting portion 450*a* and the depressed portion 440*a* serve as guides, the lifter 440 and the valve part 450 move up and down in a stable fashion, which results in a stable controllability of the flow amount control valve 400.

Figure 7:
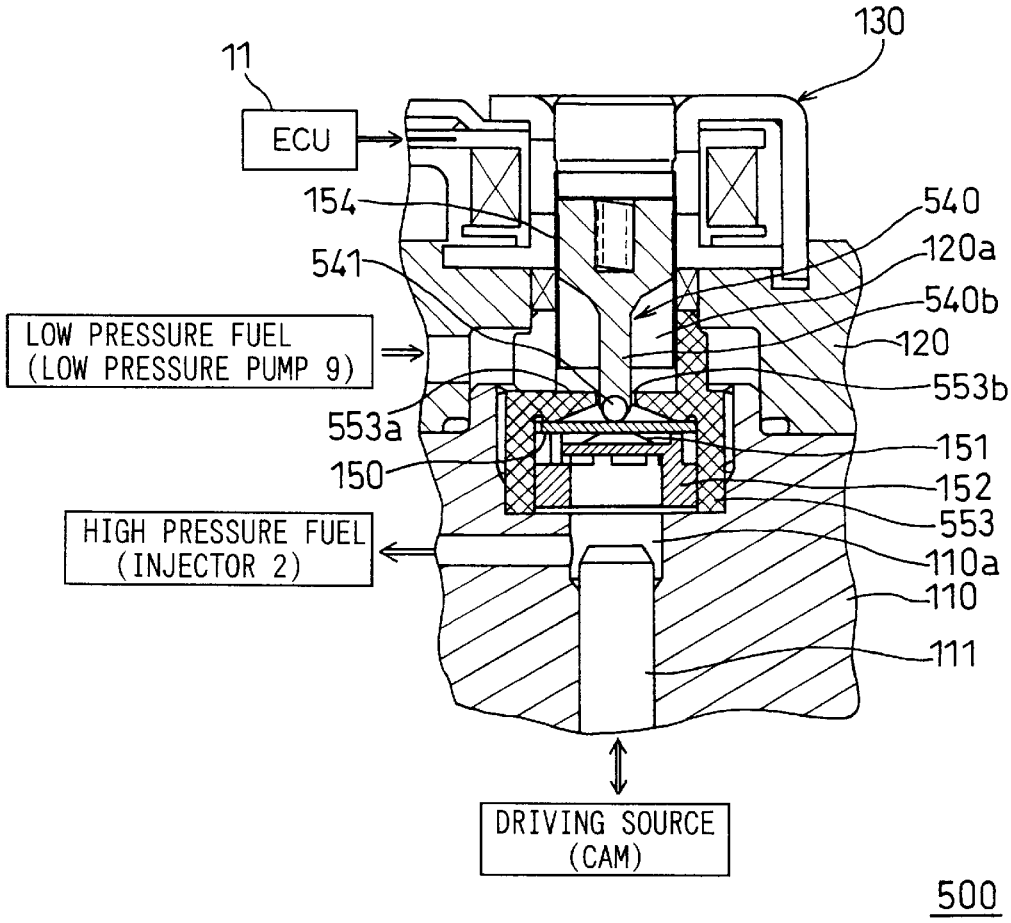
FIG. 7 is a cross-sectional view showing a flow amount control valve in accordance with a fifth embodiment of the present invention.

A flow amount control valve 500 in accordance with a fifth embodiment of the present invention is shown in FIG. 7. The flow amount control valve 500 has a wear-resisting member 541 and a valve housing 553 similar to the wear-resisting member 241 and a valve housing 153 in the second embodiment. The wear-resisting member 541 is formed of a hard steel ball and is located in the bottom end of the stem part 540*b* to form the lifter 540. The valve housing 553 has an annular guide 553*a* projecting toward the center portion from a raised portion in the center of an inner peripheral wall and the stem part 540*b* passes through the annular guide 553*a*. Further, a notch 553*b* is formed on the peripheral portion of the annular guide 553*a* to make the operating chamber 120*a* communicate with the pump chamber 110*a*.

Furthermore, the annular guide 553*a* makes the vertical movement of the lifter 540 stable. The spherical shape of the wear-resisting member 541 buried in the bottom end of the stem part 540*b* stabilizes the abutting relationship between the stem part 540*b* and the valve part 150 without requiring the respective parts to be of high precision or accuracy, which results in more stable controllability of the flow amount control valve 500. Additionally, to improve the response of the lifter and the valve part, the moving part and the stem part can be made hollow.

According to the present invention, since the stem part is made more slender than the moving part, it is possible to ensure that the operating chamber has a large volume and is adequate to suppress the pressure pulsation caused by the movement of the moving member. As a result, it is possible to provide a high pressure fuel pump to control the effect on the valve part by the pressure pulsation. Additionally, the high pressure fuel pump has excellent controllability.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A high pressure fuel pump comprising:

a pump body having a pump chamber to communicate with a low pressure fuel passage connected to a supply source of a low pressure fuel and a high pressure fuel passage for supplying a high pressure fuel to an injector side;

a plunger which is fitted into the pump chamber and is supplied with a driving force from a driving source to slidably move the plunger in the pump chamber to draw and discharge fuel; and a flow amount control valve for adjusting a flow amount of the high pressure fuel to the high pressure fuel passage by opening or closing a spill port provided in an overflow passage which fluidly communicates with the pump chamber, wherein the flow amount control valve includes:

a valve body having an operating chamber which is formed on a side opposite to the pump chamber with respect to the spill port and communicates with the overflow passage;

a valve part which is urged in a direction that seats the valve part on a valve seat formed on the pump chamber side of the spill port and which is separated from or seated on the valve seat to open or close the spill port;

a moving part which is separated from the valve part and disposed in the operating chamber and electromagnetically controls the opening or closing of the spill port by the valve part; and a stem part which is disposed in the operating chamber and transmits an urging force from the moving part to the valve part, the urging force being applied by the moving part to the valve part in a direction that separates the valve part from the valve seat, the stem part being more slender than the moving part.

2. A high pressure fuel pump according to claim 1, wherein the operating chamber constitutes at least a part of a fuel well communicating with the low pressure fuel passage and wherein the spill port serves also as an intake port of the low pressure fuel to the pump chamber.

3. A high pressure fuel pump according to claim 1, wherein the stem part moves independently of the valve part.

4. A high pressure fuel pump according to claim 1, wherein the moving part is guided in a longitudinal direction with reference to the stem part, the stem part being unguided.

5. A high pressure fuel pump according to claim 1, wherein the valve part is a plate having a circular seat surface that seats on the valve seat.

6. A high pressure fuel pump according to claim 5, wherein the stem part acts on a center of the valve part.

7. A high pressure fuel pump according to claim 6, wherein the stem part has a cross-sectional diameter smaller than a diameter of the circular seat surface of the valve part.

8. A high pressure fuel pump according to claim 7, wherein the stem part is longer than the diameter of the circular seat surface of the valve part.

9. A high pressure fuel pump comprising:

a pump body defining a plunger passage and a high pressure fuel passage;

a valve body abutting the pump body, the valve body defining an operating chamber and a low pressure fuel passage;

a plunger for moving within the plunger passage and for fluidly communicating with a pump chamber to draw fuel from the operating chamber and discharge fuel through the high pressure fuel passage; and a flow amount control valve comprising a stepped housing defining a spill port for controlling a flow amount of the low pressure fuel from the low pressure fuel passage and the operating chamber, through the spill port and into the pump chamber and subsequently into the high pressure fuel passage, the flow amount control valve further comprising;

a moving part defining a cavity for housing a biasing member;

a stem part disposed in the operating chamber for transferring a force from the moving part to a valve part, the valve part being seating against a valve seat of the stepped valve housing; and a coned disc spring for biasing the valve part against the valve seat to place the valve part in a closed position.

10. The high pressure fuel pump according to claim 9, wherein the stem part moves independently of the valve part.

11. The high pressure fuel pump according to claim 9, wherein the moving part is guided within the valve body in a longitudinal direction with reference to the stem part, the stem part being unguided.

12. The high pressure fuel pump according to claim 9, wherein the valve part is a plate having a circular seat surface that seats on the valve seat.

13. The high pressure fuel pump according to claim 9, wherein the stem part acts on a center of the valve part.

14. The high pressure fuel pump according to claim 9, wherein the stem part has a cross-sectional diameter smaller than a diameter of the circular seat surface of the valve part.

15. The high pressure fuel pump according to claim 9, wherein the stem part is longer than the diameter of the circular seat surface of the valve part.

16. The high pressure fuel pump according to claim 9, wherein a spherical wear-resisting part acts as an interface between the stem part and the valve part.

* * * * *